US008184836B2

(12) United States Patent
Iwasaki

(10) Patent No.: US 8,184,836 B2
(45) Date of Patent: May 22, 2012

(54) AUDIO APPARATUS

(75) Inventor: Yasutaka Iwasaki, Kasugai (JP)

(73) Assignee: Yamaha Corporation, Hamamatsu-shi (JP)

( * ) Notice: Subject to any disclaimer, the term of this patent is extended or adjusted under 35 U.S.C. 154(b) by 1159 days.

(21) Appl. No.: 11/988,435

(22) PCT Filed: Jul. 7, 2006

(86) PCT No.: PCT/JP2006/313603

§ 371 (c)(1),
(2), (4) Date: Jan. 7, 2008

(87) PCT Pub. No.: WO2007/007684

PCT Pub. Date: Jan. 18, 2007

(65) Prior Publication Data

US 2009/0262962 A1 Oct. 22, 2009

(30) Foreign Application Priority Data

Jul. 8, 2005 (JP) ..... 2005-200021

(51) Int. Cl.
*H04R 5/02* (2006.01)

(52) U.S. Cl. ..... 381/310

(58) Field of Classification Search ..... 381/310
See application file for complete search history.

(56) References Cited

U.S. PATENT DOCUMENTS 5,754,660 A * 5/1998 Shimizu ..... 381/17
5,862,229 A * 1/1999 Shimizu ..... 381/17
6,574,339 B1 * 6/2003 Kim et al. ..... 381/17
2003/0185404 A1 10/2003 Milsap
2004/0032955 A1 * 2/2004 Hashimoto et al. ..... 381/18
2004/0247140 A1 * 12/2004 Norris et al. ..... 381/77
2005/0105744 A1 5/2005 Lee
2007/0165878 A1 7/2007 Konagai

FOREIGN PATENT DOCUMENTS

CN 1906972 A 1/2007
DE 43 07 490 A1 9/1994
EP 1 662 842 A1 5/2006

(Continued)

OTHER PUBLICATIONS

Japanese Patent Office "Notification of Reason for Refusal" dated Dec. 16, 2010, Patent Application No. 2005-200021, 2 pages.

(Continued)

*Primary Examiner* — Elvin G Enad
*Assistant Examiner* — Alexander Talpalatskiy
(74) *Attorney, Agent, or Firm* — Pillsbury Winthrop Shaw Pittman LLP

(57) ABSTRACT

An audio apparatus inputs audio signals oriented toward a plurality of positions to speakers which output sound toward the respective positions with narrow directivity, including a table storage section which stores a table for registering the plurality of positions and volume information showing set sound levels of sounds directed toward the positions in correspondence with each other; a signal processing section for adjusting output levels of respective audio signals in accordance with set level control values; and a signal processing control section which reads the volume information for the plurality of positions by reference to the table and which sets, in the signal processing section, the level control values for the audio signals directed to the respective positions in accordance with the read information.

9 Claims, 7 Drawing Sheets

FOREIGN PATENT DOCUMENTS

| | | | |
|---|---|---|---|
| JP | A-01-276900 | | 11/1989 |
| JP | 06-205496 | | 7/1994 |
| JP | A-6-225397 | | 8/1994 |
| JP | A-09-238390 | | 9/1997 |
| JP | 11-109982 | | 4/1999 |
| JP | 2000-181468 | | 6/2000 |
| JP | 2005-064746 | | 3/2005 |
| JP | A-2005-173137 | | 6/2005 |
| WO | WO 01/62045 | A1 | 8/2001 |

OTHER PUBLICATIONS

Japanese Patent Office "Notification of Reason for Refusal" dated May 20, 2011, Patent Application No. 2005-200021, 2 pages.

European Patent Office "Extended Search Report" dated Jun. 4, 2010, Application No. 06780878.2, 5 pages.

European Patent Office "Communication Pursuant to Article 94(3) EPC" dated Apr. 12, 2011, Patent Application No. 06 780 878.2, 5 pages.

State Intellectual Property Office of People's Republic of China "Notification of First Office Action" dated Sep. 14, 2010, Application No. 200680025002.X, 5 pages.

State Intellectual Property Office of the People's Republic of China, "Notification of the Second Office Action" Patent Application No. 200680025002.X of Yamaha Corporation; issue Date: Jan. 5, 2012; 5 pages.

* cited by examiner

FIG. 2

T

| IDENTIFICATION ID | COORDINATES OF LISTENING POSITION | VOLUME INFORMATION |
|---|---|---|
| h1 | (100,200) | 50 |
| h2 | (150,200) | 40 |
| h3 | (200,200) | 60 |

AUDIO APPARATUS

This application is the National Phase of International Application PCT/JP2006/313603, filed Jul. 7, 2006 which designated the U.S. and that International Application was not published under PCT Article 21(2) in English.

TECHNICAL FIELD

The present invention relates to an audio apparatus which provides speakers, which output sound respectively to a plurality of positions with narrow directivity, with audio signals intended for the plurality of positions.

BACKGROUND ART

An audio system which inputs an audio signal to a speaker capable of changing its directivity has hitherto been known. For instance, Patent Document 1 describes an audio system which inputs an audio signal to an array speaker capable of outputting a sound beam in a plurality of orientations. The audio system can be set in such a way that a sound beam from the array speaker is directed toward a position desired by a listener. The setting is made for a plurality of positions, so that the sound beam can be output from the array speaker toward a plurality of positions desired by the listener.

Patent Publication 1: JP-A-06-205496

DISCLOSURE OF THE INVENTION

Problem that the Invention is to Solve

However, the related-art audio apparatus has the same volume setting for respective sound beams output to a plurality of positions. Therefore, when listeners are present in orientations of the respective sound beams, difficulty is encountered in providing audio at sound levels desired by the respective listeners.

In a related-art audio system, when a change has been made to a position where the sound beam is oriented, setting of the audio signals desired by the listeners must be made again in connection with this new position. Specifically, since a position to which the sound beam is oriented and a setting of an audio signal oriented to the position are only associated with each other, the relationship between the orientation and the setting of the audio signal is lost when a change is made to the orientation. Therefore, when a change is made to the orientation, the listeners must again make settings of the audio signals output to the altered orientations.

Accordingly, in order to solve the problem, a first objective of the present invention is to provide an audio apparatus capable of outputting sound at sound levels desired by respective listeners who are present in orientations of respective sound beams, and a second objective of the present invention is to provide an audio apparatus which eliminates the inconvenience of resetting the audio signals, which would otherwise be caused when a change has been made to positions where the sound beams are oriented.

Means for Solving the Problem

To solve the problems, the present invention adopts the following means.

(1) The present invention is directed toward an audio apparatus which inputs audio signals oriented toward a plurality of positions to speakers which output sound toward the respective positions with narrow directivity, the apparatus comprising:

a table storage section which stores a table for registering the plurality of positions and volume information showing set sound levels of sounds directed toward the positions in correspondence with each other;

a signal processing section for adjusting output levels of respective audio signals in accordance with set level control values; and a signal processing control section which reads the volume information for the plurality of positions by reference to the table and which sets, in the signal processing section, the level control values for the audio signals directed to the respective positions in accordance with the read information.

By means of the configuration, the table storage section stores a table used for registering a plurality of positions toward which sound is directed and volume information showing set sound levels of sound directed toward the positions in correspondence with each other. The signal processing control section makes a reference to the table, to thus read volume information for the plurality of positions, and level control values of audio signals are set in the signal processing section in accordance with the thus-read information. In accordance with the thus-set level control values, the signal processing section adjusts output levels of the audio signals directed to the respective positions. Thus, volume can be controlled individually for each of the sounds directed toward the different positions. Therefore, when the plurality of positions are set as listening positions of a plurality of listeners, sounds can be provided to the respective listeners at sound levels desired by the listeners.

(2) The present invention is directed toward the audio apparatus, and the apparatus further comprises:

an instruction signal input section for inputting an instruction signal for instructing alteration of a volume setting. In addition to the plurality of positions and the volume information, the table which associates identification information used for identifying a listener is stored in the table storage section. When the instruction signal input section receives the instruction signal including the identification information, the volume processing control section changes the volume information indicated by the identification information in the table to a sound level indicated by the instruction signal; acquires a position corresponding to the identification information and changed volume information by reference to the table; and changes the level control value set in the signal processing section in such a way that the sound directed to the acquired position comes to a sound level represented by the volume information.

According to the configuration, an instruction signal for instructing changing of a volume setting is input to the instruction signal input section. In addition to the plurality of positions and the volume information, a table in which pieces of identification information used for identifying listeners are associated with each other is stored in the table storage section. When the instruction signal including the identification information is accepted by the instruction signal input section, the signal processing control section changes the volume information showing the identification information in the table. Thus, the listeners, the positions to which sound is directed, and volume settings can be managed in a mutually-associated manner.

When the instruction signal including identification information is accepted by the instruction signal input, the signal processing control section makes a reference to the table, to thus acquire a position corresponding to the identification information and altered volume information. The level control value set in the signal processing section is changed in such a way that the sound directed to the thus-acquired position comes to a sound level indicated by the volume information.

As mentioned above, a change is made to volume settings by use of a table which manages the listeners, the positions to which sound is directed, and the volume settings in a mutually-associated manner. Therefore, even when a change is made to the positions where sound is directed, the changed positions, the identification information, and the volume settings can be associated with each other. Thereby, even when a change is made to the positions toward which sound is directed, resetting of the audio signals, such as resetting of the sound levels, do not need to be performed.

(3) The present invention is directed toward the audio apparatus, and the instruction signal input section inputs position measurement information for measuring position of the portable terminal transmitted from a portable terminal used by a listener; and the signal processing control section measures position of the portable terminal by use of the position measurement information when the position measurement information is input to the instruction signal input section and stores the measured position of the portable terminal in the table in correspondence with the identification information included in the position measurement information.

According to the configuration, the instruction signal input section inputs, from a portable terminal used by the listener, position measurement information for measuring the location of the portable terminal. When the position measurement information is input to the instruction signal input section, the signal processing control section measures the location of the portable terminal using the position measurement information. The measured position is stored in the table in correspondence with the identification information included in the position measurement information.

As mentioned above, the location of the portable terminal used by the user is measured as a listening position of the listener, and a setting is made in such a way that sound is directed toward the position. Thereby, sound can be directed toward the listening position comparatively accurately. Further, the listening position measured in correspondence with the identification information included in the position measurement information input from the portable terminal is registered in the table, and the listener and the listening position can be managed while being associated with each other.

(4) The present invention is directed toward the audio apparatus, and the speaker is an array speaker having a plurality of arranged speaker units. By means of the configuration, sound beams can be readily output toward the plurality of respective positions.

(5) The present invention is directed toward the audio apparatus, and delay times imparted to respective signals output from the plurality of arranged speaker units are set respectively, whereby directions of sounds output from the speaker are controlled; the signal processing control section sets the delay control values associated with the plurality of positions in the signal processing section; and the signal processing section imparts the delay times to the respective signals in accordance with the delay control values set by the signal processing control section.

Advantages of the Invention

According to the invention defined in claim 1 of the present invention, volume can be individually controlled for each of the sounds directed toward different positions. Therefore, when a plurality of positions are set as listening positions of a plurality of listeners, sound can be provided to the respective listeners at sound levels desired by the listeners.

According to the invention defined in claim 2 of the present invention, a change is made to volume settings by use of a table which manages listeners, positions to which sound is directed, and volume settings in a mutually-associated manner. Therefore, even when a listener has made a change to settings of the locations where sound is to be directed, the altered positions, identification information, and the volume settings can be associated with each other. Thereby, even when a change is made to the positions where sound is directed, there can be provided an audio apparatus which obviates a necessity for setting audio signals, such as resetting of sound levels.

BRIEF DESCRIPTION OF THE DRAWINGS

FIG. 2 is a view showing a positional information table T.

BEST MODE FOR IMPLEMENTING THE INVENTION

Figure 1:
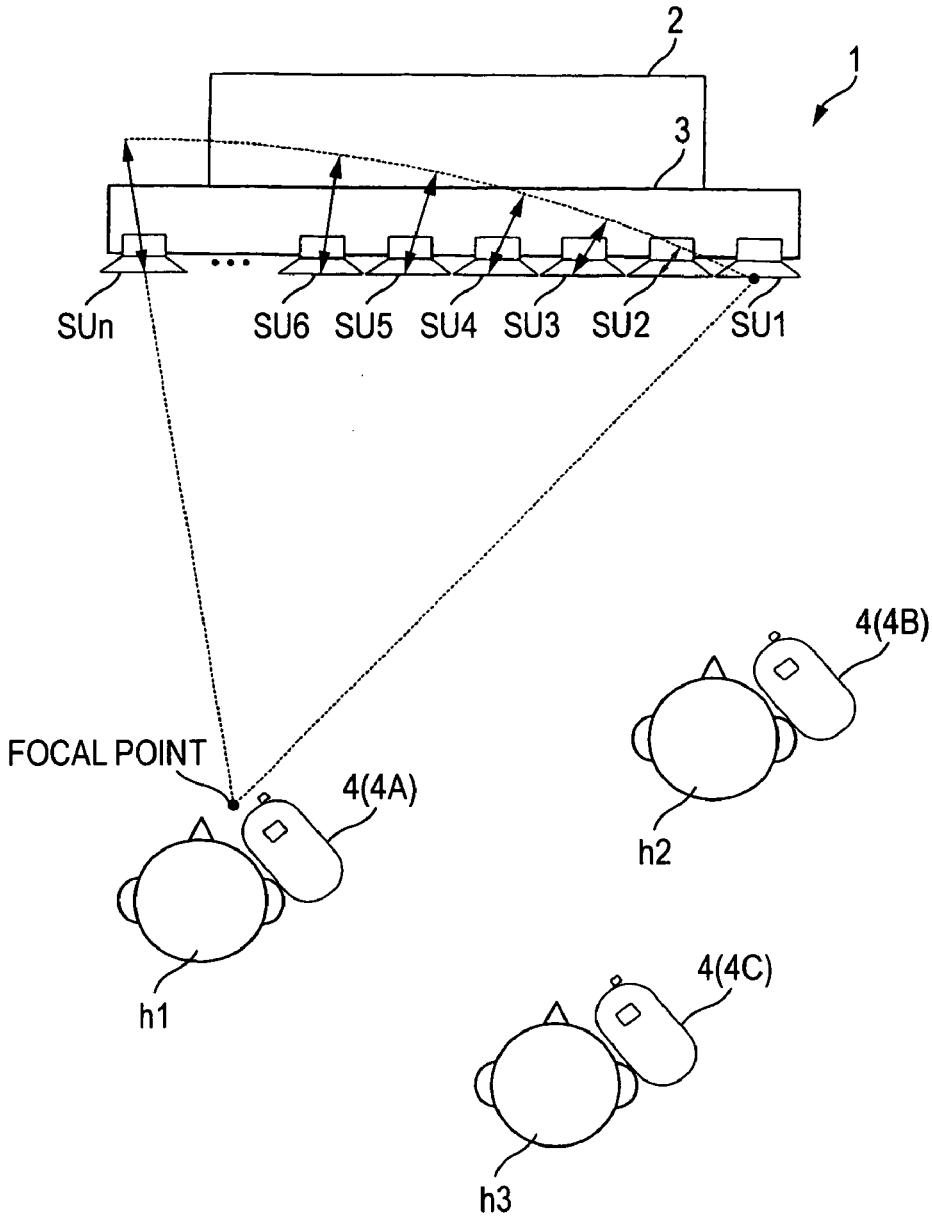
FIG. 1 is a view for describing the configuration of an array speaker constituting a karaoke system of an embodiment and directivity of a sound beam output from the speaker array.

A karaoke system 1 which is an embodiment of the present invention will be described by reference to FIGS. 1 through 7. The karaoke system 1 has a karaoke machine 2 which plays karaoke music; an array speaker 3 for outputting an audio signal input from the karaoke machine 2; and a remote controller 4 for operating the karaoke machine 2.

FIG. 1 is a view for describing the configuration of the array speaker 3 constituting the karaoke system 1 of the embodiment and directivity of a sound beam output from the speaker array. The array speaker 3 has the shape of an elongated, essentially-parallelepiped, and a plurality of speaker units SU (SU1 to SUn) arranged in the shape of a line along one side of the array speaker.

Audio signals are input to the speaker units SU from the karaoke machine 2. Respective input audio signals are imparted with such a delay time that a sound beam output from the speaker units SU1 through SUn are oriented to a focal point. Specifically, as indicated by arrows in the drawing, the audio signals are imparted with such delay times that sounds output from the respective speaker units SU simultaneously arrive at the focal point. As a result, the orientation of the sound beam can be controlled such that a sound beam is oriented toward the focal point.

In the karaoke system 1 of the present embodiment, when a plurality of listeners (h1 through h3) are present in a karaoke room, the array speaker 3 outputs the respective sound beams toward listening positions where the listening positions of the respective listeners h1 through h3 are taken as a focal point. The drawing omits the manner of the sound beam being output to the listeners h2 and h3. The karaoke system 1 has a function of detecting coordinates of listening positions (hereinafter described as "listening-position coordinates") of the listeners h1 through h3.

As illustrated, the respective listeners h1 through h3 have remote controllers 4 lent by a karaoke shop, or like the like. The present karaoke system 1 detects coordinates of positions of the respective remote controllers 4 (4A through 4C) as coordinates of listening positions of the listeners h1 through h3. Processing for detecting the coordinates of the listening positions (position detection processing) will be described in detail later.

The respective remote controllers 4 are assigned unique identifications ID. In the present karaoke system 1, the identifications ID of the remote controllers 4 are registered, as identification information for distinguishing the users of the remote controllers 4 as listeners, in the positional information table T such as that shown in FIG. 2, in association with the detected coordinates of the listening positions. The positional information table T is stored in the karaoke machine 2.

A configuration in which unique identifications ID are assigned to the listeners h1 through h3 may also be adopted in place of the configuration in which the identifications ID are previously assigned to the remote controllers 4. In the case of that configuration, the listeners h1 through h3 input the identifications ID into remote controllers 4 which they use.

In the karaoke system 1, a volume-level setting can be changed for each of the sound beams directed to the listening positions of the listeners h1 through h3. The volume-level setting is changed when a volume change command signal for changing a volume-level setting is input by the remote controller 4, or like situation, and the volume-level setting can be changed to a volume-level setting desired by the listener. As a result, the listeners h1 through h3 can listen to sound at respective desired sound levels. Processing for changing the volume setting (volume change processing) will be described in detail later.

The volume-level settings of the respective sound beams are also registered in the positional information table T shown in FIG. 2 in association with corresponding identifications ID and coordinates of a listening position. Therefore, the volume-level setting (sound level information), coordinates of a listening position, and an identification ID for distinguishing the listeners h1 through h3 from each other are registered in the positional information table T while remaining associated with each other. In the karaoke system 1, even when changes are made to the coordinates of the listening positions as a result of alteration of the listening positions of the listeners h1 through h3, the volume-level settings of the sound beams directed to altered listening positions can be maintained so as to become identical with those achieved before alteration by means of taking the identifications ID as clues.

Figure 3:
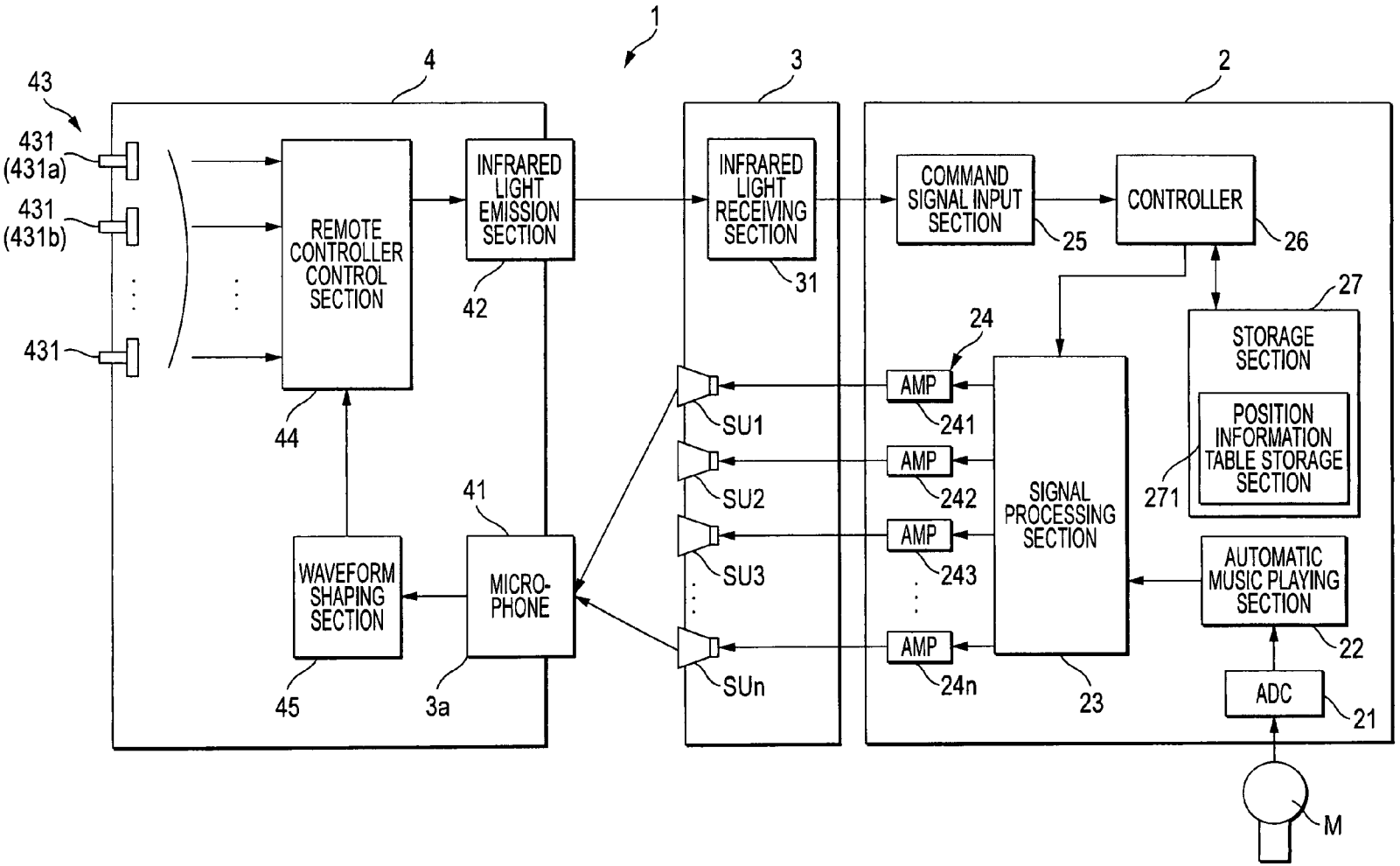
FIG. 3 is a block diagram schematically showing the configuration of a karaoke system 1.

FIG. 3 is a block diagram schematically showing the configuration of the karaoke system 1.

In addition to the previously-described speaker unit SU, the array speaker 3 has an infrared light receiving section 31. The infrared light receiving section 31 receives a command signal which is infrared light from the remote controller 4, converts the command signal into an electric signal, and inputs the electric signal to the karaoke machine 2 (a command signal input section 25 to be described later).

The karaoke machine 2 has an AD converter 21, an automatic music playing section 22, a signal processing section 23, an amplifier 24, a command signal input section 25, a controller 26, and a storage section 27. A song audio signal of a singer from a microphone M is input to the AD converter 21. The AD converter 21 converts the input analogue song audio signal into a digital audio signal and inputs the thus-converted signal to the automatic music playing section 22.

The automatic music playing section 22 has an operation section for receiving user's operation, as well as having a storage section for storing karaoke music data, a sequencer or sound source for playing karaoke music data, and the like. The song audio signal from the AD converter 21 is input to the automatic music playing section 22. The automatic music playing section 22 synthesizes the input song audio signal with the audio signal of the karaoke music automatically played by the sequencer. The automatic music playing section 22 inputs the thus-synthesized audio signal to the signal processing section 23.

The signal processing section 23 is implemented by means of: for example, a DSP (Digital Signal Processor), and the like. The signal processing section 23 independently controls a sound beam for each listening position in such a way that an independent sound beam is formed for each of the plurality of listening positions. In the case shown in FIG. 1, since the listening positions to which the sound beam is to be directed are three listening positions of the listeners h1 through h3, the signal processing section 23 performs three independent beam control operations in connection with the audio signal. Signals for a sound beam generated through the respective control operations are described as signals x1 through x3.

Specifically, the controller 26 sets level control values on the signal processing section 23. The level control values are set in correspondence with the listening positions, and the signal processing section 23 independently adjusts the level of an audio signal for each listening position. Thus, signals x1 through x3 are adjusted to respective output levels conforming to the corresponding level control values.

Thus, in the present embodiment, the level of the audio signal is independently adjusted for each listening position. Therefore, the volume setting can be changed for respective sound beams directed toward different listening positions. Thus, the listeners h1 through h3 can listen to sound at different sound levels. For instance, when the listener h1 is singing a song, there is a case where the listener h1 wants to listen to his/her song but where the other listeners h2 and h3 do not want to listen to the song at too high sound levels. In this case, only the listener h1 can listen to the song at a high sound level without causing the listeners h2 and h3 to listen to the song at a high sound level.

The signal processing section 23 divides the signals x1 through x3 having adjusted output levels into (n) signals which are equal in number to the speaker units SU. Specifically, the signals x1 through x3 assigned to the listening positions of the listeners h1 through h3 are separated into "n," whereupon 3x n signals are generated. N signals into which the signal x1 is divided are described as x11 to x1*n*. N signals into which the signal x2 is divided are described as x21 through x2n. N signals into which the signal x3 is divided are described as x31 through x3n.

The controller 26 sets delay control values in the signal processing section 23 so as to become associated with the listening positions. In accordance with the delay control values, the signal processing section 23 imparts a delay time to each of the signals x11 to x1n, x21 to x2n, and x31 to x3n.

Specifically, the signals x11 to x1n are imparted with a delay time conforming to the delay control value corresponding to the listening position of the listener h1. The signals x21 to x2n are imparted with a delay time conforming to the delay control value corresponding to the listening position of the listener h2. The signals x31 to xn are imparted with a delay time conforming to the delay control value corresponding to the listening position of the listener h3. As a result, sound beams can be output so as to be directed toward the respective listening positions of the listeners h1 through h3.

The signal processing section 23 inputs the signals x11 to x1n, x21 to x2n, and x31 to x3n imparted with the delay times to corresponding amplifiers 24. The amplifiers 24 are provided in equal number to the speaker units SU1 to SUn. When these amplifiers 24 are distinguished from each other, the amplifiers are imparted with the same numerals as those of the corresponding speaker units SU1 through SUn, to thus become described as amplifiers 241 to 24n.

Of the signals x11 to x1n, x21 to x2n, and x31 to x3n, signals assigned to the same speaker unit SU are input to each of the amplifiers 241 to 24n from the signal processing section 23. For instance, signals x11, x21, and x31 to be input to the speaker unit SU1 are input to the amplifier 241. Thus, the sound beams are output from the respective speaker units SU1 through SUn toward the respective listening positions of the listeners h1 through h3.

The command signal input section 25 is an interface circuit for accepting an input of a command signal from the infrared light receiving section 31. The command signal input section 25 inputs the entered command signal to the controller 26. The command signal includes a music selection command signal for instructing selection of karaoke music, a position detection command signal for instructing detection of coordinates of the listening position, a volume change command signal for instructing changing of a sound level, and the like. The position detection command signal and the volume change command signal each include an identification ID of the remote controller 4 that is a sender of the signals, thereby enabling identification of, as a sender, which one of the remote controllers 4A to 4C.

The controller 26 is implemented by; for example, a CPU or the like, and controls operations of individual sections of the karaoke machine 2. The controller 26 executes a program stored in the storage section 27, thereby performing position detection processing of the karaoke machine. Position detection processing of the karaoke machine is one for measuring or detecting listening positions of the listeners h1 through h3 by use of a notification signal (position measurement information) used for measuring the listening positions of the listeners h1 through h3 received from the remote controllers 4.

Figure 4:
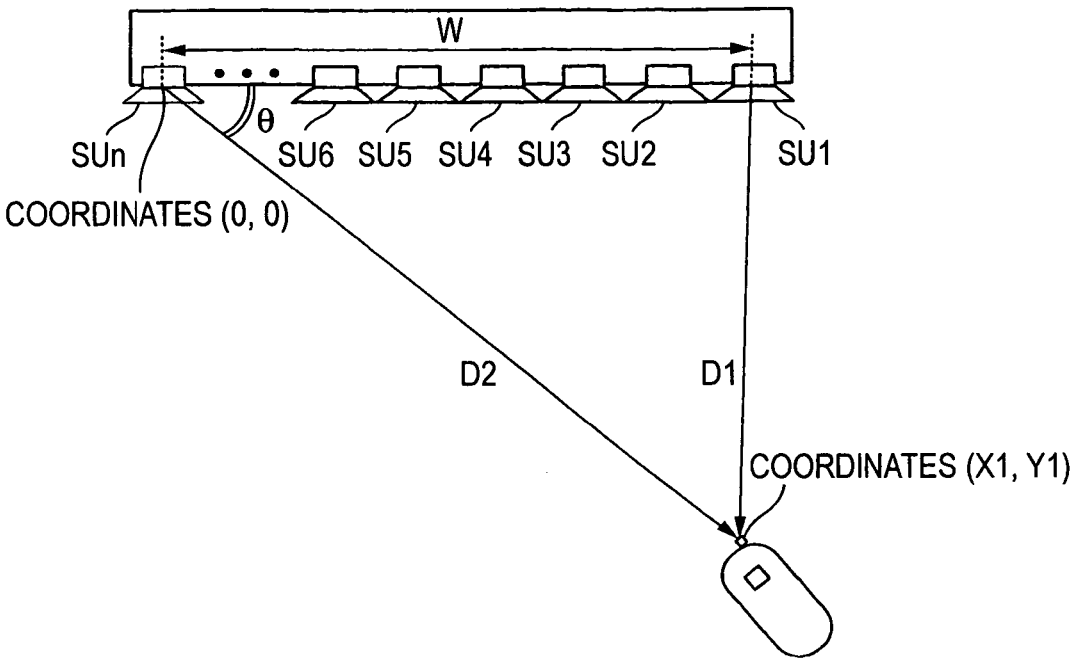
FIG. 4 is a view for describing an example of position detection processing.

FIG. 4 is a view for describing an example of position detection processing. During position detection processing, sound of predetermined time length is output at a given frequency as position measurement sound from the speaker units SU1 and SUn disposed at both ends. A microphone 41 is built in each of the remote controllers 4, as will be described later. When sound for measurement purpose is input to the microphone 41, a notification signal for notifying an input of sound is transmitted from the remote controller 4. By use of the notification signal, there is determined a time t1 which elapses from when the sound for positional measurement purpose is output from the speaker unit SU1 until when the sound is input to the microphone 41. Subsequently, the sound for positional measurement purpose is output from the speaker unit SUn, thereby determining a time t2 which elapses from when the sound is output until when the sound is input to the microphone 41.

The times t1 and t2 are multiplied by sound velocity, thereby determining a distance D1 from the speaker unit SU1 to the microphone 41 and a distance D2 from the speaker unit SUn to the microphone 41. An angle θ is determined by the cosine theorem; that is, Equation (1) provided below, through use of the distances D1, D2 and a distance W from the speaker unit SU1 to the speaker unit SUn. The angle θ is formed between an array surface and a line connecting the speaker unit SUn to the microphone 41.

$$D1^2=D2^2+W^2-2\times D2\times W\times\cos(\theta) \quad \text{Eq. (1)}$$

Next, the controller 26 computes coordinates (X1, Y1) of a listening position while the center position of the speaker unit SUn is taken as a point of origin (0, 0). Coordinates of the listening position are computed from an angle θ, a distance D2, and a distance W according to Equations (2) and (3) provided below.

$$X1=D2\times\cos(\theta) \quad \text{Eq. (2)}$$

$$Y2=D2\times\sin(\theta) \quad \text{Eq. (3)}$$

Position detection processing of the above-mentioned karaoke machine will be described in detail by reference to FIGS. 5 and 6.

The controller 26 registers the detected coordinates of the listening positions of the listeners h1 through h3 in the positional information table T shown in FIG. 2 in correspondence with the identifications ID of the respective listeners. The controller 26 reads the coordinates of the position from the positional information table T and sets, in the signal processing section 23, a delay control value which directs the sound beams to the thus-read listening position.

The above processing is an example method for detecting the listening positions of the respective listeners h1 through h3, and the listening positions may also be detected by use of another method. Moreover, the controller 26 can also make a setting such that sound output from the array speaker 3 can be heard in the entire karaoke room, by means of cancelling control operation for directing the sound beam to the respective listening positions.

The control section 26 also executes a program stored in the storage section 27, to thus perform volume change processing for changing a volume setting of the sound beam. During volume change processing, the sound levels of the sound beams directed to the respective listening positions of the listeners h1 through h3 can be changed individually. Specifically, when a volume change command signal is input, control is performed in such a way that the sound level of a sound beam corresponding to the identification ID included in the volume change command so as to become a volume setting instructed by the command signal. Specifically, the controller 26 sets a level control value of the signal processing section 23 such that sound reaches a listening position at a sound level indicted by the volume change command signal.

Thereby, sound levels of sound beams directed to different listening positions can be individually changed. In order to change the volume setting of the sound beam, even when a change is made to coordinates of a listening position conforming to the identification ID, the same volume setting can be maintained.

Specifically, only the coordinates of a position are associated with the volume setting. In a case where an identification ID and a volume setting are not associated with each other, a listener must again set a sound volume in connection with coordinates of a new position. However, since the identification ID is associated with the coordinates of the listening position and the volume setting, coordinates of a new listening position and the volume setting can be associated with each other by reference to the identification ID. Thus, efforts to make a volume setting again, which would otherwise be required after making of a change to the coordinates of the listening position, can be omitted.

When an individual volume change mode is set, the sound level of the sound beam can be set individually, as mentioned above. When the individual volume change mode remains cleared, the controller 26 changes the sound levels of all of the sound beams to the sound level indicated by the volume change command signal.

The storage section 27 is formed from a rewritable storage device; for example, flash memory or the like, and is provided with a positional information table storage area 271 storing the positional information table T such as that shown in FIG. 2. The storage section 27 stores various programs which cause the karaoke machine 2 to perform volume change processing and position detection processing, as well as storing data required to execute the programs.

The configuration of the remote controller 4 will be described hereunder. In addition to including the microphone 41, the remote controller 4 has an infrared light emission section 42, an operation section 43, a remote controller control section 44, and a waveform shaping section 45. The infrared light emission section 42 has an infrared light emission element, or the like, and outputs infrared light as a command signal responsive to an input command code. The operation section 43 has a plurality of operation buttons 431, and accepts operation performed by the listener as a result of the operation buttons 431 being depressed by a finger or the like. The operation section 43 inputs to the remote controller control section 44 an operation signal indicating the operation buttons 431 depressed by the listener.

The remote controller control section 44 is implemented by a microcomputer, or the like, and controls operation of individual sections of the remote controller 4. The remote controller control section 44 stores a command code responsive to the respective operation buttons 431. When an operation signal is input, the remote. controller control section 44 specifies a command code corresponding to an operation button 431 indicated by the operation signal, and inputs the thus-specified command code to the infrared light emission section 42.

For instance, when the operation button (a position detection button 431*a*) for causing detection of the position of the remote controller 4 is depressed and when the operation signal showing depression of the button is received, the remote controller control section 44 inputs, to the infrared light emission section 42, a command code for causing the karaoke machine 2 to detect the position of the karaoke machine. The infrared light emission section 42 outputs the command code as a position detection command signal.

When another operation button 431 (a volume setting button 431*b*) for setting a sound beam to a desired sound level is depressed and when an operation signal showing depression of the button is received, the remote controller control section 44 inputs, to the infrared light emission section 42, a command code for causing the karaoke machine 2 to perform sound level change processing. The infrared light emission section 42 outputs the command code as a volume change command signal.

The remote controller control section 44 performs a stored program, thereby performing processing for detecting the position of the remote controller. Processing for detecting the position of the remote controller is one for transmitting to the array speaker 3 a notification signal which causes measurement of coordinates of the position of the remote controller 4. As mentioned above, the array speaker 3 outputs sound for measurement purpose from the speaker units SU1 and SUn. As mentioned previously, during position detection processing performed by the remote controller, an input is notified when the sound for measurement purpose is input. Hence, the notification signal is transmitted by use of the infrared light emission section 42. By reference to FIGS. 5 and 6, position detection processing performed by the remote controller will be described in detail later.

A sound signal collected by the microphone 41 is input to the waveform shaping section 45. The waveform shaping section 45 has a filter, such as a bandpass filter, and the frequency of sound for measurement purpose is set in the filter. The waveform shaping section 45 causes the input signal to pass through the filter, thereby separating from the input signal only a component of the sound for measurement purpose. The waveform shaping section 45 inputs to the remote controller control section 44 a signal of the separated sound for measurement purpose.

Figure 5:
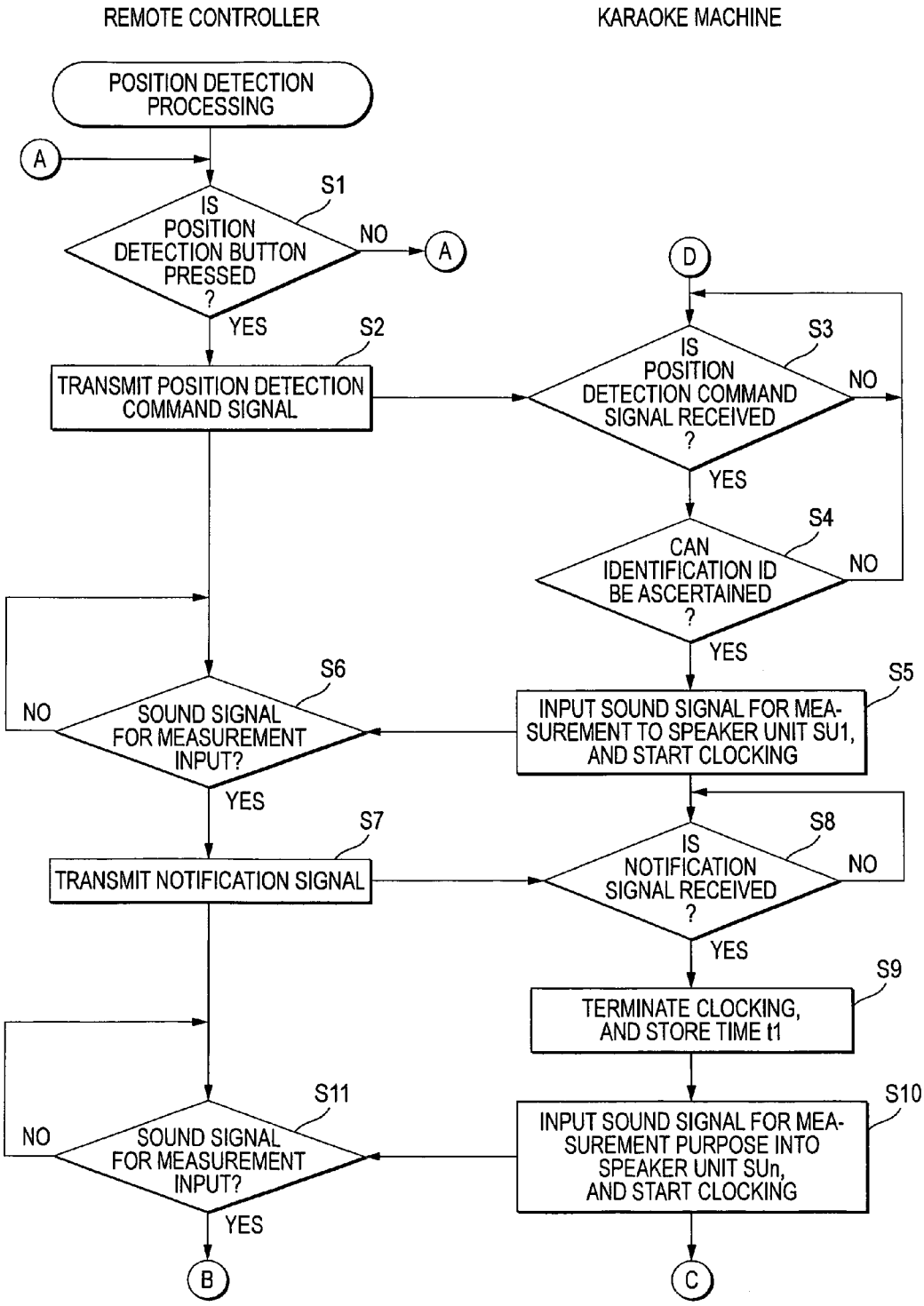
FIG. 5 is a flowchart (part 1) showing position detection processing performed by the karaoke system shown in FIG. 3.
Figure 6:
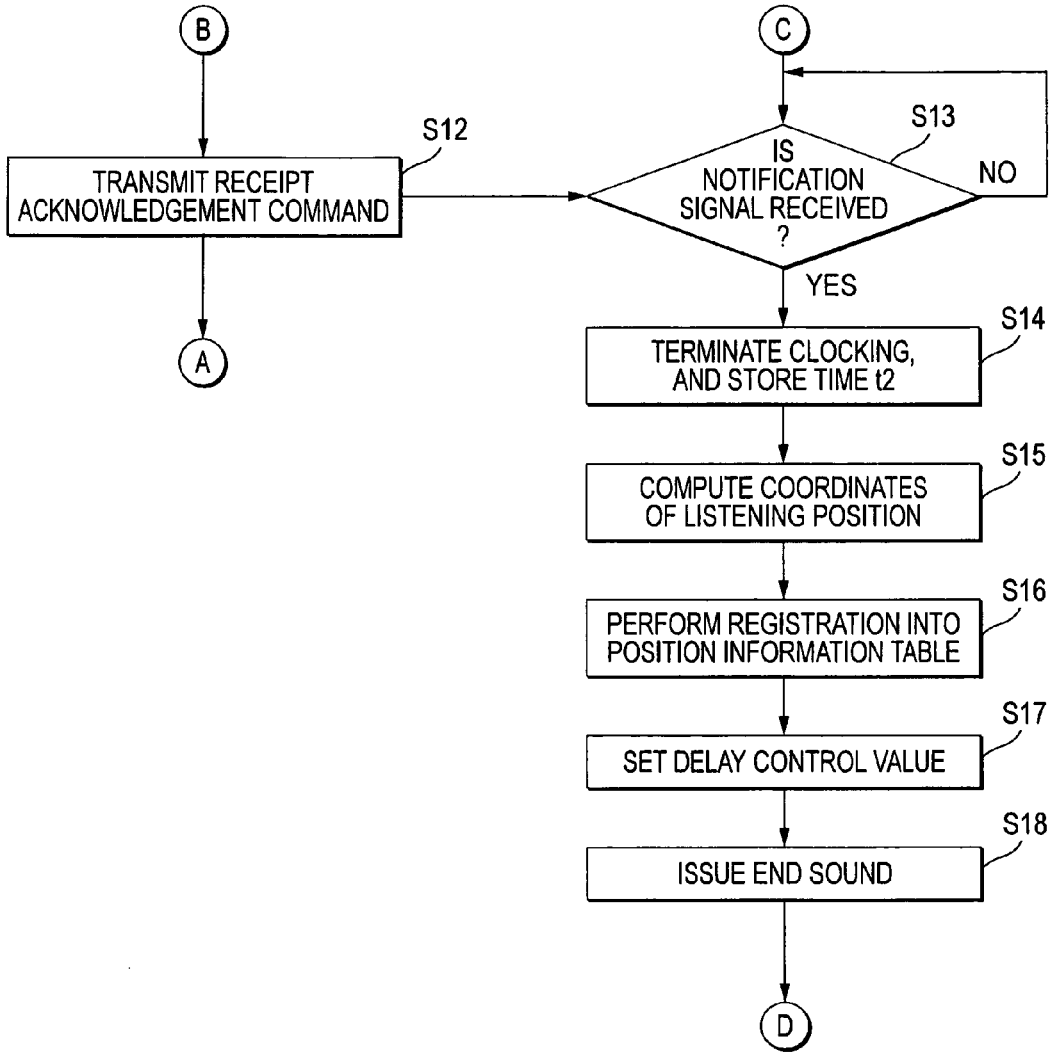
FIG. 6 is a flowchart (part 2) showing position detection processing performed by the karaoke system shown in FIG. 3.

FIGS. 5 and 6 show flowcharts (parts 1 and 2) including position detection processing performed by the karaoke system 1 shown in FIG. 3. Of the position detection processing operations, processing performed by the remote controller 4 is position detection processing to be performed by the remote controller, and processing performed by the karaoke machine 2 is position detection processing to be performed by the karaoke machine.

First, the remote controller control section 44 repetitively determines, at a predetermined time interval, whether or not the position detection button 431*a* is depressed, and waits until YES is determined (S1). When the position detection button 431*a* is determined to be depressed (YES in S1), the remote controller control section 44 transmits a position detection command signal for instructing performance of position detection processing to be performed by the karaoke machine (S2).

The karaoke machine 2 repetitively determines whether or not the controller 26 has input a position detection command signal, and waits until YES is determined (S3). When the position detection command signal is determined to be input (YES in S3), the controller 26 determines whether or not the identification ID can be ascertained (S4). Specifically, the controller 26 determines whether or not an identification ID included in the position detection command signal can be acquired.

When the identification ID cannot be ascertained (NO in S4), the controller 26 outputs an error sound signal to the signal processing section 23, thereby returning processing to step S3. In the meantime, when the identification ID can be ascertained (YES in S4), the controller 26 stores the identification ID in the storage section 27. Subsequently, the controller 26 instructs the signal processing section 23 to generate a sound signal for measurement purpose and input the sound signal to the speaker unit SU1, and commences clocking by use of built-in clocking means (S5).

The remote controller 4 repetitively determines, at a predetermined time interval, whether or not sound for measurement purpose is received after the remote controller control section 44 performs processing pertaining to step S2, and waits until YES is determined (S6). When the sound for measurement purpose is determined to be received (YES in S6), the remote control section 44 transmits the notification signal for notifying receipt of the sound, through use of the infrared light emission section 42 (S7).

When a remote controller 4 other than the remote controller 4 transmitting a start command signal in step S1 receives the sound for measurement purpose, the other remote controller 4 discards the sound. Therefore, the other remote controller 4 does not transmit a notification signal, and only the remote controller 4 transmitted the start command signal transmits the notification signal.

After performance of processing pertaining to step S5, the karaoke machine 2 repetitively determines, at a predetermined time interval, whether or not the controller 26 inputs a notification signal, and waits until YES is determined (S8). When the notification signal is determined to be input (YES in S8), the controller 26 terminates clocking operation and computes a time t1 from the clocked time (S9).

Next, the controller 26 instructs the signal processing section 23 to input a sound signal for measurement purpose to the speaker unit SUn, and commences clocking by use of the built-in clocking means (S10). After the remote controller control section 44 performs processing pertaining to step S7, the remote controller 4 repetitively determines, at a predetermined time interval, whether or not the sound for measurement purpose is received, and waits until YES is determined (S11).

By reference to FIG. 6, when the sound for measurement purpose is determined to be received (YES in S11), the remote controller control section 44 transmits a notification signal for reporting receipt of the sound by use of the infrared light emission section 42 (S12). Subsequently, the remote controller control section 44 returns position detection processing to be performed by the remote controller to step S1.

After performance of processing pertaining to step S10, the karaoke machine 2 repetitively determines, at a predetermined time interval, whether or not the controller 26 inputs a receipt acknowledgement message, and waits until YES is determined (S13). When the receipt acknowledgement message is determined to be input (YES in S13), the controller 26 completes clocking operation, thereby computing a time t2 from the clocked time (S14).

Subsequently, the controller 26 performs computing operations of Equations (1) through (3), such as those mentioned above, by use of the times t1 and t2, to thus compute coordinates of the listening position (S15). The controller 26 reads an identification ID from the storage section 27, and registers the coordinates of the listening position in the positional information table T in correspondence with the read identification ID (S16).

When volume information corresponding to the identification ID is not registered in the positional information table T (when volume information is first registered), the controller 26 registers volume information by means of a predetermined initial value. In contrast, when the identification ID, the coordinates of the listening position, and the volume information have already been registered, the controller 26 changes only the coordinates of the listening position corresponding to the read identification ID and leaves the volume information unchanged.

The controller 26 reads the coordinates of the listening position and the volume information from the positional information table T. The controller 26 sets, in the signal processing section 23, such a delay control value which directs the sound beam to the listening position represented by the coordinates (S17). In addition, the controller 26 also sets a level control value which causes the sound beam to reach the listening position at a sound level indicated by the volume information.

The controller 26 instructs the signal processing section 23 to generate an end sound signal and input the sound signal to the speaker units SU1 through SUn. The signal processing section 23 performs processing as instructed, whereupon end sound is issued (S18). Normal end may also be displayed on a display section, which is omitted from the drawings, of the remote controller 4. Subsequently, the controller 26 returns position detection processing to be performed by the karaoke machine to step S3.

By means of position detection processing, coordinates of the position of the remote controller 4 can be measured as coordinates of a listening position. Since the thus-measured coordinates of the listening position are registered in the positional information table T in correspondence with the identification ID, so that the listeners h1 through h3 can be individually associated with the listening positions. As a result, even when a change has been made to the listening position, which one of the listeners h1 through h3 had its listening position changed can be identified.

Figure 7:
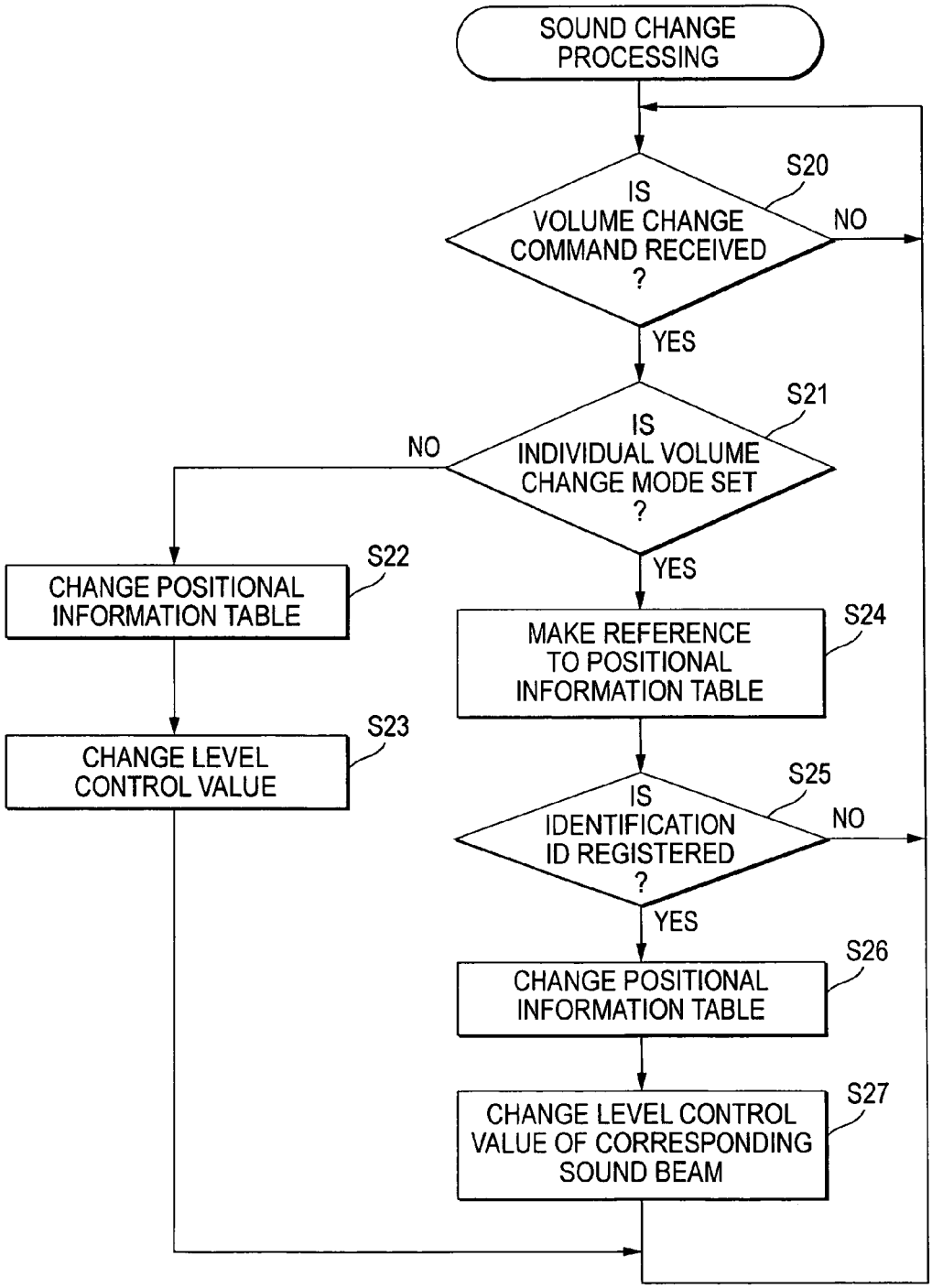
FIG. 7 is a flow chart showing sound level change processing performed by the karaoke system shown in FIG. 3.

FIG. 7 is a flowchart showing volume change processing performed by the karaoke machine 2 shown in FIG. 3. First, the controller 26 repetitively determines, at a predetermined time interval, whether or not the volume change command signal is input, and waits until YES is determined (S20). When the volume change command signal is determined to be input (YES in S20), the controller 26 determines whether or not the individual volume change mode is set (S21).

The individual volume change mode is changed or cleared by means of the listener's operation performed by use of the operation section 43 of the remote controller 4. When the individual volume change mode is selected, the controller 26 stores a flag showing the selection. When the mode is cleared, the flag is deleted.

When the individual volume change mode is determined not to be set (determined to be cleared) (NO in S21), the controller 26 changes volume information about all of the identifications ID registered in the positional information table T such that all of the sound beams achieve sound levels indicated by the volume change command signal (S22). For instance, when a volume change command for lowering a sound level by two is input, a change is made to the volume information registered in the positional information table T in such a way that the sound level is lowered by two.

The controller 26 changes settings of level control values of the signals x1 through x3 in such a way that the sound levels of the sound beams achieve a sound level indicated by the volume change command signal (S23).

Moreover, when the individual volume change mode is determined to be set (YES in S21), the controller 26 makes a reference to the positional information table T (S24). The volume change command signal includes an identification ID for distinguishing the sender remote controller 4. The controller 26 makes a reference to the positional information table T by means of the identification ID.

The controller 26 determines whether or not the identification ID is registered in the positional information table T (S25). When the identification ID is determined not to be registered in the positional information table T (NO in S25), the controller 26 returns processing to step S20. When the individual volume change mode is set and when the identification ID is not registered in the positional information table T, coordinates of the listening position are not detected, and the sound beam directed to the remote controller 4 of the sender is not output. Therefore, processing returns to step S20 without changing a sound level.

In the meantime, when the identification ID is determined to be registered in the positional information table T (YES in S25), the controller 26 changes volume information about coordinates of a listening position corresponding to the identification ID in the positional information table T (S26). The change is made in such a way that the sound level of the sound beam comes to a sound level indicated by the volume change command signal. The controller 26 reads the coordinates of the listening position corresponding to the identification ID and altered volume information.

Subsequently, the controller 26 changes the level control value of the signal processing section 23 in such a way that the sound beam directed to the listening position indicated by the coordinates comes to a sound level indicated by the volume change command signal (S27). Specifically, the level control value of any corresponding one of the signals x1 through x3 is changed.

During volume change processing mentioned above, volume settings of respective sound beams directed toward the listening positions of the listeners h1 through h3 can be individually changed to a volume setting desired by the listener. Thereby, all of the listeners h1 through h3 can hear sound at their desired volume settings. For instance, in a situation where the listener h1 is signing a song, when the song is poor and when the listeners h2 and h3 are reluctant to hear the song, only the sound levels of the sound beams directed to the listeners h2 and h3 can be lowered.

The volume change command signal includes an identification ID, and a reference is made to the positional information table T by means of the identification ID, whereby coordinates of a listening position corresponding to the identification ID are read. A level control value corresponding to the coordinates of the listening position is controlled. Thus, a sound level is controlled by distinguishing a corresponding listener among the listeners h1 through h3 by means of the identification ID. Therefore, even when a change is made to the coordinates of the listening positions, the listeners h1 through h3 do not need to again perform operation for setting sound levels.

The present embodiment can adopt the following modifications.

(1) in the present embodiment, when the position detection button 431*a* is depressed, coordinates of the position of the remote controller 4 are detected, but the present embodiment is not limited to such a configuration. For instance, the position of the remote controller 4 may also be repeatedly detected during a period from when the position detection button 4 is depressed until when the operation button 431 for ending position detecting operation is depressed. By means of such a configuration, when the listener moves along with the remote controller 4 during the period, coordinates of the position are detected so as to follow the movement.

(2) In the present embodiment, only when the listener depresses the sound level change button 431*b*, the volume setting of each of the sound beams is changed. However, the present embodiment is not limited to the configuration. Specifically, there may also be adopted a configuration where the controller 26 automatically changes the volume settings so as to become optimum for the listening positions of the listeners h1 through h3. For instance, the controller 26 sets the sound level of the sound beam directed to a listening position distant from the array speaker 3 so as to become greater than the sound level of the sound beam directed to a closer listening position.

(3) In the present embodiment, the sound signal for measurement purpose is input to the speaker units SU1 and SUn. However, the present embodiment is not limited to such a configuration, and there may also be adopted a configuration where a sound signal for measurement purpose is input to another speaker unit SU.

(4) In the present embodiment, coordinates of the listening positions are measured by use of the sound for measurement purpose output from the speaker units SU1 and SUn. However, another method may also be used to detect coordinates of listening positions. For instance, there may also be adopted a configuration where a sound field is captured by a video and where listening positions of the listeners h1 through h3 are measured by use of the video image, or the like.

(5) In the present embodiment, the speakers SU1 through SUn are shared among the sound beams directed to a plurality of listening positions; however, the present embodiment is not limited to this configuration. Specifically, there may also be adopted a configuration where the speaker units SU are not shared among the sound beams and where sound beams are output from different portions of the speaker units SU1 through SUn.

(6) The microphone 41 may not be incorporated in the remote controller 4. The essential requirement is to connect an external microphone 41 to the remote controller 4 and arrange the microphone 41 to a listening position. Moreover, a terminal device is not limited to the remote controller 4, and another terminal device (e.g., a general-purpose machine or the like) having the capability of inputting a signal from the microphone 41 and a function of communicating with the karaoke machine 2 may also be adopted.

(7) Although the karaoke machine 2 and the array speaker 3 are separated from each other, they may also be configured integrally. The karaoke machine 2 has a function section for subjecting the audio signal to signal processing for adjusting a delay time or an output level, the function section may also be provided in another audio device. Specifically, the audio device inputs from the karaoke machine 2 an audio signal into which an audio signal of karaoke music and an audio signal of a song of a singer are synthesized. The audio device controls an output level of an input audio signal and imparts a delay time to the input audio signal, and subsequently inputs the signal to the speaker units SU1 through SUn.

(8) The configuration of the array speaker 3 is configured from the speaker units SU1 through SUn arranged in a line, but the speaker is not limited to the configuration. The speaker may also be configured from a speaker unit SU arranged in; for example, a matrix pattern or a honeycomb pattern.

(9) Normal speakers may also be used in place of the array speaker 3, thereby directing a plurality of sound beams to the listening positions of the listeners h1 through h3.

(10) The present invention is not limited to the karaoke machine. The essential requirement is to apply the present invention to an audio apparatus which outputs sound so as to individually direct sound to a plurality of listeners. For instance, the present invention may also be applied to a home audio system so that family members can listen to sound at different sound levels. In this case, different contents may also be provided for respective members rather than a single content being provided to all of the members. In this case, contents (channel numbers or the like) are additionally registered in the positional information table T in correspondence with the identifications ID.

The invention claimed is:

1. An audio apparatus which inputs audio signals to speakers which output sound beams toward a plurality of positions with narrow directivity, the apparatus comprising:

a table storage section which stores a table for registering the plurality of positions and volume information showing set sound levels of the sound beams directed toward the positions in correspondence with each other;

a signal processing section which adjusts output levels of respective audio signals in accordance with set level control values; and a signal processing control section which reads the volume information for the plurality of positions by reference to the table and which sets, in the signal processing section, the level control values for the audio signals directed to the respective positions in accordance with the read volume information.

2. The audio apparatus according to claim 1 further including a command signal input section which inputs a command signal for instructing alteration of a volume setting, wherein the table storage section stores the table which associates identification information used for identifying a listener, in addition to storing the plurality of positions and the volume information, the signal processing control section changes the volume information indicated by the identification information in the table to a sound level indicated by the command signal when the command signal input section receives the command signal including the identification information, and the signal processing control section acquires a position corresponding to the identification information and changed volume information by reference to the table, and changes the level control value set in the signal processing section so that the sound beam directed to the acquired position comes to a sound level represented by the volume information.

3. An audio apparatus which inputs audio signals to speakers which output sound beams toward a plurality of positions with narrow directivity, the apparatus comprising:

a table storage section which stores a table for registering the plurality of positions and volume information showing set sound levels of the sound beams directed toward the positions in corresponding with each other;

a signal processing section which adjusts output levels of respective audio signals in accordance with set level control values;

a signal processing control section which reads the volume information for the plurality of positions by reference to the table and which sets, in the signal processing section, the level control values for the audio signals directed to the respective positions in accordance with the read volume information; and a command signal input section which inputs a command signal for instructing alteration of a volume setting, wherein the table storage section stores the table which associates identification information used for identifying a listener, in addition to storing the plurality of positions and the volume information, the signal processing control section changes the volume information indicated by the identification information in the table to a sound level indicated by the command signal when the command signal input section receives the command signal including the identification information, the signal processing control section acquires a position corresponding to the identification information and changed volume information by reference to the table, and changes the level control value set in the signal processing section so that the sound beam directed to the acquired position comes to a sound level represented by the volume information, the command signal input section inputs position measurement information, for measuring a position of a portable terminal, transmitted from the portable terminal used by a listener, and the signal processing control section measures a position of the portable terminal using the position measurement information when the position measurement information is input to the command signal input section and stores the measured position of the portable terminal in the table in correspondence with the identification information included in the position measurement information.

4. The audio apparatus according to claim 1, wherein the speakers are an array of speaker having a plurality of arranged speaker units.

5. The audio apparatus according to claim 4, wherein delay times imparted to respective signals output from the plurality of arranged speaker units are set respectively so that directions of the sounds beams output from the speaker are controlled, the signal processing control section sets the delay control values associated with the plurality of positions in the signal processing section, and the signal processing section imparts the delay times to the respective signals in accordance with the delay control values set by the signal processing control section.

6. The audio apparatus according to claim 2, wherein the speakers are an array of speaker having a plurality of arranged speaker units.

7. The audio apparatus according to claim 6, wherein delay times imparted to respective signals output from the plurality of arranged speaker units are set respectively so that directions of the sound beams output from the speaker are controlled, the signal processing control section sets the delay control values associated with the plurality of positions in the signal processing section, and the signal processing section imparts the delay times to the respective signals in accordance with the delay control values set by the signal processing control section.

8. The audio apparatus according to claim 3, wherein the speakers are an array of speaker having a plurality of arranged speaker units.

9. The audio apparatus according to claim 8, wherein delay times imparted to respective signals output from the plurality of arranged speaker units are set respectively so that directions of the sound beams output from the speaker are controlled, the signal processing control section sets the delay control values associated with the plurality of positions in the signal processing section, and the signal processing section imparts the delay times to the respective signals in accordance with the delay control values set by the signal processing control section.

* * * * *